United States Patent [19]

Chancellor, Jr.

[11] Patent Number: 4,902,072

[45] Date of Patent: Feb. 20, 1990

[54] CHAIR WITH PIVOTAL ARM EXTENSION

[75] Inventor: Charles W. Chancellor, Jr., Midland, Tex.

[73] Assignee: Tela Flynt Chancellor, Midland, Tex.

[21] Appl. No.: 323,835

[22] Filed: Mar. 15, 1989

[51] Int. Cl.[4] ..... A47C 7/54

[52] U.S. Cl. ..... 297/417; 297/115

[58] Field of Search ..... 297/417, 411, 412, 115, 297/116, 117; 248/118

[56] References Cited

U.S. PATENT DOCUMENTS

| | | | |
|---|---|---|---|
| 156,177 | 10/1874 | Schabel | 296/116 |
| 3,103,383 | 9/1963 | Cannon et al. | 297/417 X |
| 4,657,305 | 4/1987 | Meiller | 297/417 |

FOREIGN PATENT DOCUMENTS

| | | | |
|---|---|---|---|
| 2169797 | 7/1986 | United Kingdom | 297/417 |

*Primary Examiner*—James T. McCall

*Attorney, Agent, or Firm*—Fleit, Jacobson, Cohn, Price, Holman & Stern

[57] ABSTRACT

A chair of the type having a pivotal armrest or armrests in which an extension is provided at the end of the pivotal armrest that is attached to the chair back with the extension being substantially perpendicular to the armrest and extending downwardly when the armrest is in a horizontal operative position. When the armrest of the chair is pivoted upwardly to a position alongside the side edge of the back of the chair, the extension on the armrest is oriented in generally a horizontal position. The extension is substantially shorter than the armrest to provide a short armrest for the elbow area of the arm thereby enabling the chair having a pivotal armrest or armrests to be utilized in the normal manner so that the armrest can be pivoted upwardly to an out of the way position alongside the chair back when it is desired to gain access to a desk drawer or the like with the extension providing a support for the elbow area of the arm even when the armrest is pivoted upwardly to the stored or out of the way position.

3 Claims, 1 Drawing Sheet

CHAIR WITH PIVOTAL ARM EXTENSION

BACKGROUND OF THE INVENTION

Field Of The Invention

The present invention generally relates to a chair of the type having a pivotal armrest or armrests in which an extension is provided at the end of the pivotal armrest that is attached to the chair back with the extension being substantially perpendicular to the armrest and extending downwardly when the armrest is in a horizontal operative position. When the armrest of the chair is pivoted upwardly to a position alongside the side edge of the back of the chair, the extension on the armrest is oriented in generally a horizontal position. The extension is substantially shorter than the armrest to provide a short armrest for the elbow area of the arm thereby enabling the chair having a pivotal armrest or armrests to be utilized in the normal manner so that the armrest can be pivoted upwardly to an out of the way position alongside the chair back when it is desired to gain access to a desk drawer or the like with the extension providing a support for the elbow area of the arm even when the armrest is pivoted upwardly to the stored or out of the way position.

INFORMATION DISCLOSURE STATEMENT

Office chairs have been provided with stationary armrests which function adequately to support the arms of the occupant of the chair during swivel movement, rocking movement and the like. When an office chair is swiveled and it is desired to reach to the side of the chair, such as to open a drawer or the like, the armrest becomes an obstacle. There has been developed and there is commercially available a chair having pivotal armrests which can move between a horizontal operative position in vertically spaced relation to the seat of the chair with the armrests providing support for the arms in a conventional manner and yet being able to be pivoted upwardly to a position alongside the chair back so that the armrests are in a stored or out of the way position thereby enabling easier access from the side edge of the chair seat to a desk drawer or the like when the drawer is to be opened or closed or when it is necessary to reach laterally from the chair. This type of chair is available from Lux Steel of Elkhart, Indiana. However, when the armrests are pivoted to a vertical inoperative or stored position, there is no support whatsoever for the arms of the occupant of the chair.

SUMMARY OF THE INVENTION

An object of the present invention is to provide an extension on the pivotal armrests of an office chair with movement of the pivotal armrests to an inoperative, stored position alongside the side edges of the chair back, positioning a short extension to form a support for the elbow area of the occupant of the chair thereby making the chair more comfortable to use and enabling access laterally from the chair but yet providing a support for at least a portion of the arm of the occupant.

Another object of the invention is to provide an extension for the pivotal armrests of an office chair in which each armrest is substantially conventional except that an extension is provided on the end thereof where it is pivotally attached to the chair with the extension being at substantially right angles to the armrest and being upholstered or finished in substantially the same manner as the armrest rendering the extension compatible in appearance and function to provide a support for the elbow area of the occupant of the chair even when the armrests are pivoted upwardly to a stored position.

A further object of the invention is to provide an extension for the pivotal armrests of an office chair which will not alter the appearance characteristics of the chair but increase the function of the armrests since they will be provided with a support for the elbow area when the armrests are pivoted to the stored position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
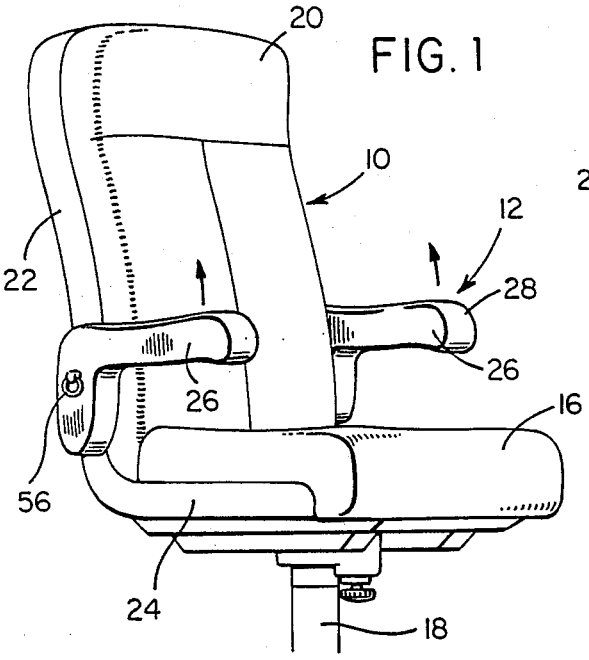
FIG. 1 is a perspective view of an office chair illustrating the extensions on the pivotal armrests with the armrests in normal operative position.

The office chair utilizing the armrest extension of the present invention is generally designated by the numeral 10 with the conventional armrests being designated by the numeral 12 and the extension of this invention being designated by reference numeral 14. The chair 10 includes the usual upholstered and cushioned seat 16 supported by a pedestal 18 and a wheeled base (not shown). The chair seat may swivel about a vertical axis and also rock about a generally horizontal axis with an adjustable spring bias being provided to resist rearward rocking movement with the chair 10 also including a generally upwardly extending upholstered chair back 20 of desired height to provide adequate support for an occupant. As illustrated, the chair back 20 includes side edge portions 22 which merge with and join with the side edge portions 24 of the seat 16 all of which represents conventional office chair construction.

Figure 3:
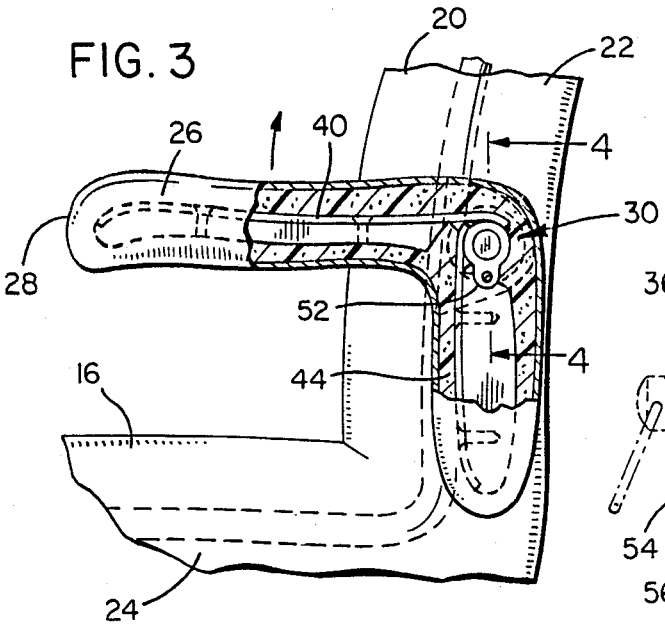
FIG. 3 a fragmental, elevational view with portions broken away illustrating the construction of the armrest extension of the present invention.
Figure 4:
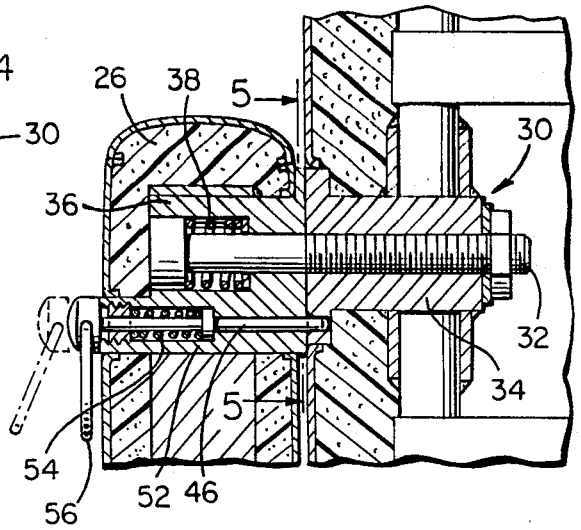
FIG. 4 is a sectional view taken substantially upon a plane passing along section line 4—4 on FIG. 3 illustrating the structural details of the pivotal connection and lock pin between the armrest and chair back.
Figure 5:
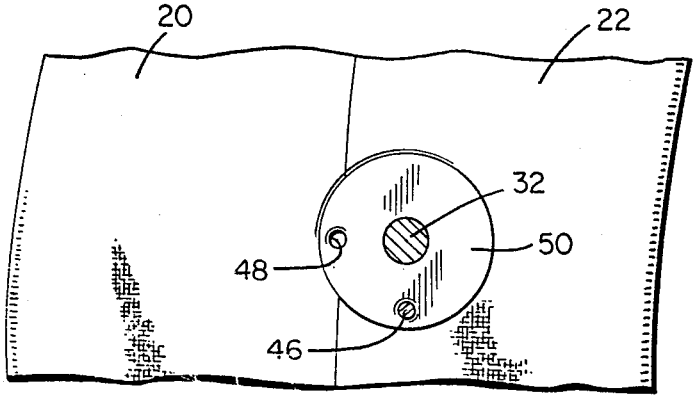
FIG. 5 is a sectional view taken along section line 5—5 on FIG. 4 illustrating details of the lock pin.

The office chair is provided with armrests 12 which include a horizontal component 26 that extends forwardly from the side walls or edges 22 of the chair back 20 in generally parallel, vertically spaced relation to the chair seat 16 with the armrest component 26 terminating in a rounded forward end 28 which is spaced inwardly from the front edge of the seat 16 in a conventional manner. When the chair is swiveled so the occupant faces laterally of the desk or the like and it is desired to reach laterally from the chair to a desk to open a drawer or obtain an article from the desk, the armrest component 26 is in the path of movement of the hand and arm of the occupant of the chair. To alleviate this problem, an office chair has been developed in which the armrest component 26 can pivot about a horizontal pivotal connection generally designated by reference numeral 30 which may include a pivot pin or bolt 32 received in a sleeve 34 in the chair back and a sleeve 36 in the extension arm with the sleeves and bolt being resiliently retained and frictionally retained in position by a coil spring assembly 38 of conventional construction. As illustrated in FIG. 3, the armrest 26 includes an interior, upholstered rigid frame member 40 to provide adequate support for the armrest 26. As indicated previously, the chair 10 along with the armrest 12 is known and is a commercially available item.

Figure 2:
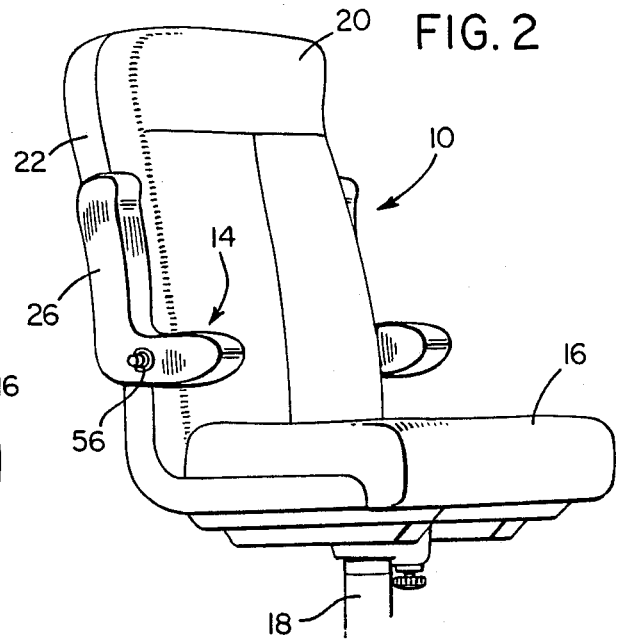
FIG. 2 is a perspective view similar to FIG. 1 but illustrating the armrests in stored position pivoted upwardly alongside the side edges of the back of the chair with the armrest extensions then being positioned in operative position in horizontally disposed extending relation from the side edges of the chair back in spaced vertical relation to the chair seat.

The extension 14 on the armrest 12 constitutes the present invention and the extension 14 includes a short armrest component 42 which is upholstered and cushioned at 44 and provided with a rigid frame 46 in a manner similar to the frame 40. The armrest extension 42 is substantially perpendicular to the armrest component 26 and extends downwardly from the pivot connection 30 alongside the side edge of the seat back 20 when the armrest component 26 is in horizontal operative position. However, when the armrest 26 is pivoted upwardly to its stored or inoperative position, the extension 42 then projects a short distance forwardly of the front surface of the seat back 20 as illustrated in FIG. 2 thereby forming a support or armrest for the elbow and adjacent region of the forearm while yet enabling lateral access to be had by moving the arm laterally from the chair seat in order to open a drawer, pick an article up from the desk or the like.

Each armrest 12 is releasably locked in vertical inoperative position by a lock pin 46 which extends through an aperture 48 in a flange 50 on sleeve 34. The pin is slidably mounted on sleeve 36 by a bracket 52 and spring 54 biases the pin toward locked position. A pull ring 56 is provided on the pin 46 to retract it to unlock the armrest to permit it to return to horizontal operative position.

By incorporating the extensions 14 on the armrests 12, the functional aspects of the upholstered office chair 10 are enhanced by providing a short armrest for the elbow and adjacent portions of the forearm when the conventional pivotal armrest 12 has been moved to a stored position thereby still enabling lateral access to be had from the side edges of the seat of the chair while providing a support for the elbow region of the arms of the occupant of the chair.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In an office chair having a seat and backrest supported in rigid relation to each other, a pair of armrests mounted in cantilever fashion on the chair backrest, means pivotally mounting at least one of the armrests from the backrest for movement between an operative generally horizontal position spaced in parallel relation above the seat of the chair to a generally vertical inoperative stored position alongside the side edge of the chair backrest with the end of the armrest remote from the pivotal mounting means being disposed above the pivotal mounting means, the improvement comprising an extension on the end of the pivotal armrest adjacent the pivotal mounting means, said extention being relatively short as compared to the length of the pivotal armrest, being rigid therewith and being generally perpendicular thereto for movement between a generally vertical inoperative position depending from the armrest when the armrest is in said operative position to a generally horizontal operative position extending forwardly from the backrest in cantilever fashion in generally spaced parallel relation above the seat when the armrest is moved to said inoperative stored position to provide a support for the elbow region of an arm forwardly of the backrest while enabling lateral access to be had to a desk driver drawer or other area from the side edge of the chair seat and backrest of the chair with the upwardly extending armrest limiting rearward movement of the elbow region on the extension, said means pivotally mounting the armrest and extension to the side edge of the chair backrest including means positively and releasably retaining the armrest and extension in both of their positions.

2. In combination with a pivotal armrest mounted on the backrest of a chair and extending forwardly from the backrest when in operative generally horizontal position with the forward end of the armrest being free for upward swinging movement to an inoperative position alongside the backrest, an extension in rigid, substantially perpendicular relation to the end of the armrest pivotally connected to the chair backrest for movement to a generally horizontal operative position projecting forwardly from the armrest when the armrest is pivoted upwardly to said inoperative position with the extension being substantially shorter than the armrest to provide a support extending forwardly from the armrest and backrest in cantilever fashion for supporting the elbow and adjacent region of the forearm when the extension is in the horizontal operative position thereby enabling an occupant of the chair to reach laterally from the chair in relation to the armrest and backrest while providing a support surface on the upper surface of the extension for the elbow and adjacent region of the forearm with the upwardly extending armrest limiting rearward movement of the elbow on the support surface, said extension also enabling a person occupying the chair to swing laterally from the chair seat when desired with the length of the extension being sufficiently short to enable a person to swing laterally in relation to the chair seat and backrest to which the armrest is connected.

3. The structure as defined in claim 2 wherein said pivotal armrest and backrest includes a positive lock means to retain the armrest and the extension in both positions.

* * * * *